US006193640B1

(12) United States Patent
Weis

(10) Patent No.: US 6,193,640 B1
(45) Date of Patent: Feb. 27, 2001

(54) PAPER FEEDING IN A FOLDER

(75) Inventor: Anton Weis, Lorsch (DE)

(73) Assignee: Koening & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/284,235

(22) PCT Filed: Oct. 14, 1997

(86) PCT No.: PCT/DE97/02340

§ 371 Date: Apr. 14, 1999

§ 102(e) Date: Apr. 14, 1999

(87) PCT Pub. No.: WO98/16386

PCT Pub. Date: Apr. 23, 1998

(30) Foreign Application Priority Data

Oct. 14, 1996 (DE) ..... 196 42 420

(51) Int. Cl.[7] ..... B31F 7/00

(52) U.S. Cl. ..... 493/346; 493/345; 493/359; 493/360; 493/367; 270/6; 270/10; 270/20.1

(58) Field of Search ..... 493/346, 345, 493/359, 360, 367, 381, 357, 363, 325, 324; 270/6, 10, 20.1, 42, 43, 41, 32; 226/109, 110

(56) References Cited

U.S. PATENT DOCUMENTS

| | | | | |
|---|---|---|---|---|
| 1,738,324 | | 12/1929 | Scott . | |
| 1,796,643 | | 3/1931 | Ball . | |
| 3,802,693 | * | 4/1974 | Grachev et al. | 270/6 |
| 3,809,303 | | 5/1974 | Brunner . | |
| 4,925,170 | | 5/1990 | Weis . | |
| 5,123,316 | * | 6/1992 | Niedemaier et al. | 83/29 |
| 5,685,528 | | 11/1997 | Weis . | |
| 5,749,567 | * | 5/1998 | DeAngelis | 270/10 |
| 5,906,307 | * | 5/1999 | Albert et al. | 226/109 |

FOREIGN PATENT DOCUMENTS

| | | |
|---|---|---|
| 1919695 | 4/1969 | (DE) . |
| 24 35 583 | 7/1974 | (DE) . |
| 85 01 065 U | 1/1985 | (DE) . |
| 3811909 | 4/1988 | (DE) . |
| 4439615 | 11/1994 | (DE) . |

* cited by examiner

*Primary Examiner*—Stephen F. Gerrity
*Assistant Examiner*—Sam Tawfik
(74) *Attorney, Agent, or Firm*—Jones, Tullar & Cooper P.C.

(57) ABSTRACT

Folders in a web-fed rotary printing press are associated with two spaced horizontal planes. Each of these planes is provided with a superstructure carriage that supports a plurality of turning bars. Each of the superstructure carriages can be displaced horizontally with respect to the other carriage and with respect to the folders.

10 Claims, 1 Drawing Sheet

PAPER FEEDING IN A FOLDER

FIELD OF THE INVENTION

The present invention relates to a paper web feeding device for a folding mechanism of a web-fed rotary printing press. A plurality of partial paper webs are combined into one or more partial paper web strands.

DESCRIPTION OF THE PRIOR ART

From DE 38 11 909 A1 it is known, in connection with paper web feeding devices, for a folding mechanism to employ a superstructure, which consists of traction, register and guide rollers, as well as of turning bars, with a longitudinal folding unit for so-called "funnel production", as well as for so-called "magazine production". A multitude of longitudinally cut partial paper webs which, in the end, enter the transverse folding unit of the folding mechanism for folding, results from the wide paper webs, which are printed, in particular, in rotogravure printing. To this end, a multitude of traction, register and guide rollers, as well as turning bars, which are arranged above each other in the superstructure, is required, this leads to a great structural height of the web-fed rotary printing press.

DE 44 39 615 A1 describes a paper feeding device for folding mechanisms of a web-fed rotary printing press. In this device, superstructure carriages are provided in two spaced apart planes and one of the superstructure carriages is displaceable.

DE-OS 19 19 695 shows displaceable folding mechanisms.

SUMMARY OF THE INVENTION

The present invention is based on the object of providing a device for feeding a plurality of partial paper webs, longitudinally cut from a particularly wide paper web, to one or two folding mechanisms of a web-fed rotary printing press.

In accordance with the invention, this object is attained by providing a superstructure carriage assembly having two separate superstructure carriages arranged on two spaced planes. At least one of the superstructure carriages is displaceable on its assigned plane. Each of the superstructure carriages has a plurality of turning bars.

BRIEF DESCRIPTION OF THE DRAWINGS

The present invention will be explained in greater detail by means of an a preferred embodiment. The associated drawings show in.

DESCRIPTION OF THE PREFERRED EMBODIMENT

Figure 1:
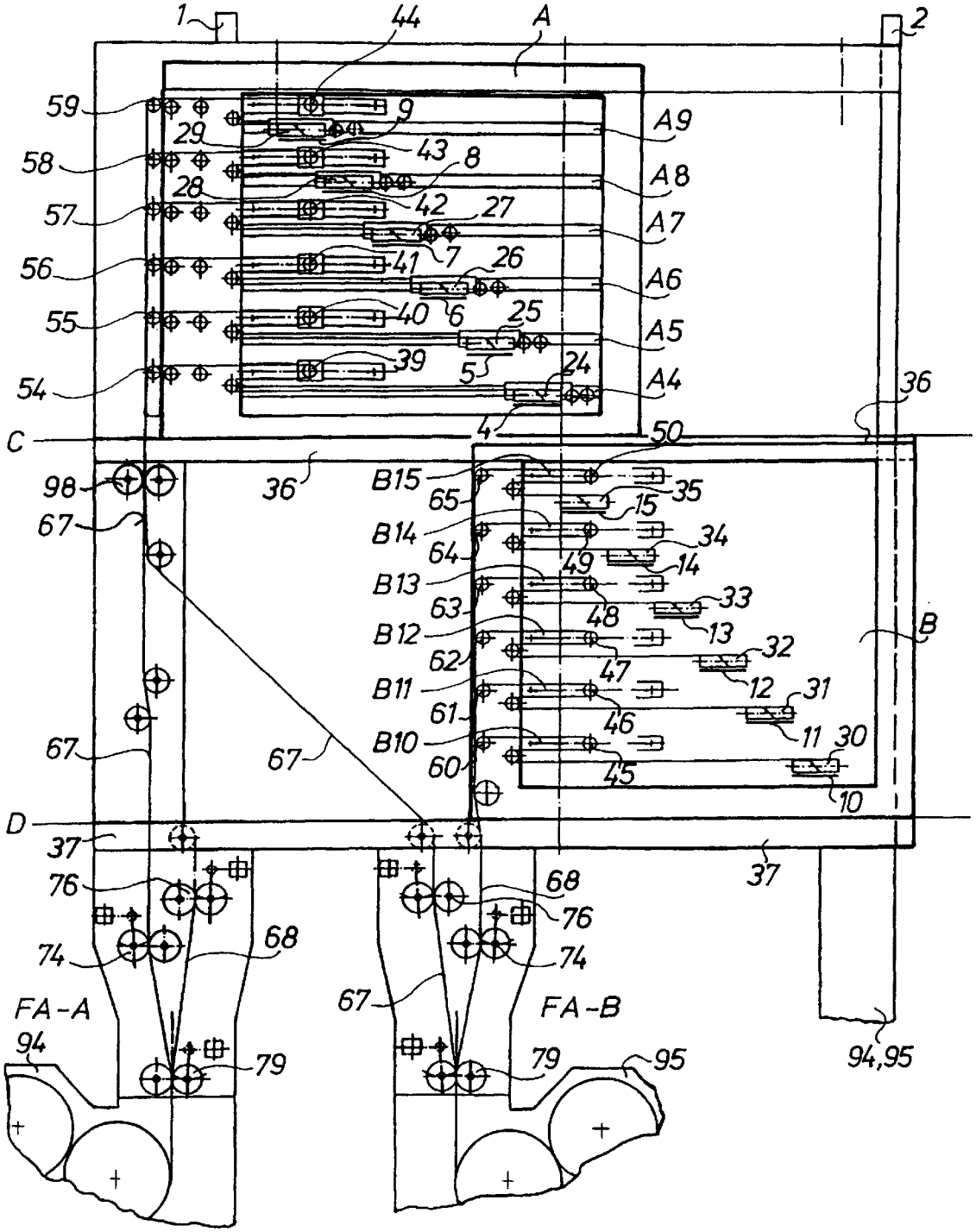
FIG. 1, a schematic representation of a paper web feeding device for folding mechanisms in connection with a magazine production.

A printed paper web, having a width corresponding to the width b of a printing cylinder of, for example, 3.6 to 4 m, enters a longitudinal cutting unit, not represented, from print units, not represented, of a web-fed rotary printing press, for example rotogravure print units arranged between lateral frames 1, 2. In the longitudinal cutting unit, the very wide paper web is longitudinally cut into, for example, twelve partial paper webs 4 to 15 of equal width. The partial paper webs 4 to 15 are conducted to a first, upper superstructure carriage A, connected with the lateral frames 1, 2, as well as to a second, lower superstructure carriage B. Partial paper web guide groups A4 to A9 are arranged in the upper superstructure carriage A, partial paper web guide groups B10 to B15 are arranged in the lower superstructure carriage B. The partial paper web guide groups A4 to A9 and B10 to B10 are arranged above each other for guiding and diverting the partial paper webs 4 to 15. Each one of the partial paper web guide groups A4 to A9, as well as B10 to B15 have one of the turning bars 24 to 35, one of the register rollers 39 to 50, as well as one of the traction rollers 54 to 65.

The superstructure carriages A and B are embodied as three-dimensionally extending carriages or cars in a web construction. They can be horizontally moved back and forth along two horizontal planes located one below the other transversely to the direction of travel of the uncut web. They can also be moved in or against the direction of running of the uncut, i.e. not longitudinally cut paper web, and can be arrested in either left and right, or front or rear end positions. It is possible, by means of this, to feed the first partial paper web strand 67, constituted by the partial paper webs 4, 5, 6, 7, 8 and 9 inside the superstructure carriage A, and the second partial paper web strand 68, constituted by the partial paper webs 10, 11, 12, 13, 14 and 15 inside the superstructure carriage B, to a left folding mechanism 94 arranged underneath the lower superstructure carriage B, and/or to a right folding mechanism 95, arranged next to the left folding mechanism 94, the partial paper web streams can also be fed by diverting rollers, to a front or rear "half-wide" folding mechanism 95, or respectively to a "multi-width", for example a "double-width" folding mechanism.

Paper entry into the folding mechanisms 94, 95 takes place by use respective pairs of traction rollers 74, 76, 79 which are, known per se.

The upper superstructure carriage A is displaceable, guided and held in place, for example, on two upper horizontal supports 36, these support are fixed in place on the folding mechanism. The upper superstructure carriage A is guided by means of dovetailed guides is displaceable by at least one half the maximally possible paper web width calculated by ½×printing cylinder barrel length, and cable fixed in place.

The lower superstructure carriage B is displaceable, guided and held in place on two lower horizontal supports 37, these supports 37 are fixed in place on the folding mechanism. The upper superstructure carriage A is guided by means of dovetailed guides is displaceable by at least one half maximally possible paper web width calculated by ½×printing cylinder barrel length, and cable fixed in place.

The turning bars 24 to 35 are each displaceable within the carriages A and B in a known manner, preferably by an amount which at least corresponds to half the maximum paper web width.

By means of the arrangement of the two superstructure carriages A and B, which can be horizontally displaced transversely in respect to the running direction of the not longitudinally cut paper web, and of the turning bars 24 to 35, which are displaceable in the direction of and transversely to the running direction of the not longitudinally cut paper web, and of the register rollers 39 to 50, which are displaceable in the direction of and opposite to the running direction of the diverted partial paper webs, it is possible to employ so-called "single-width", but also so-called "multi-width", for example "double-width"folding mechanisms. This means that the lengths of the folding cylinders are matched to the width of the signatures created in a single stream. This is in contrast to folding mechanisms, wherein the length of the folding cylinders is matched to two streams of signatures created next to each other.

The superstructure carriages A and B can be displaced in such a way that, for example, the partial paper webs 4 to 9, combined into a first partial paper web strand 67, can be fed, depending on the position of the carriage A, selectively to the left folding mechanism 94 (folding mechanism FA-A) or the right folding mechanism 95 (folding mechanism FA-B). It is furthermore possible that the partial paper webs 10 to 15 of the superstructure carriage B, combined into a second partial paper web strand 68, can be fed, depending on the position of the superstructure carriage B, selectively to the right folding mechanism 95 or the left folding mechanism 94.

In the first configuration, in their left end position, the superstructure carriages A and B are located below each other on the left, so that the left partial paper web strand 67 enters the left folding mechanism 94 via the left traction rollers 74, and the right partial paper web strand 68 enters the left folding mechanism 94 via the right traction rollers 76 of the left folding mechanism (folding mechanism FA-A). In this case, the turning bars 24 to 29 are in their left position.

In the second configuration, the upper superstructure carriage A and the lower superstructure carriage B can be moved into their right end position on top of each other and arrested in place.

The turning bars 24 to 35 are in their left end position, so that the left partial paper web strand 67 from the superstructure carriage A enters the right folding mechanism 95 (folding mechanism FA-B) via the left traction rollers 76, and the right partial paper web strand 68 via the right traction rollers 74.

In a third configuration of the superstructure carriages A and B as seen in FIG. 1, the upper superstructure carriage A has been moved and arrested into its extreme left position, the lower superstructure carriage B into its extreme right position. Its turning bars 30 to 35 of the lower superstructure carriage B are offset in a "stair-step-like" manner, namely rising in the direction toward the imagined center of the uncut paper web.

As already mentioned, the upper superstructure carriage A is in its extreme left position. Its turning bars 24 to 29 are offset in a "stair-step-like" manner falling in the direction toward the imagined center of the uncut paper web. The centers of all turning bars 30 to 35, 24 to 29 are located on an inclined straight line (rising from the left). The right to the upper superstructure carriage A feeds the left folding mechanism 94 (folding mechanism FA-A), the lower superstructure carriage B feeds the right folding mechanism 95 (folding mechanism FA-B).

However, still another configuration of the superstructure carriages A and B in relation to each other is possible. In this fourth configuration the upper superstructure carriage A is in its right end position, and the lower superstructure carriage B is in its left end position. The turning bars 30 to 35, 24 to 29 are accordingly arranged to rise in a "stair-step-like" manner from the left to the right.

"Single-width" folding mechanisms are understood to be folding mechanisms, whose width is laid out to the width of several, for example two, partial paper webs 4 to 15 running next to each other, or respectively partial paper web strands 67, 68 running next to each other and made of partial paper webs 4 to 15.

Therefore several "single-width" or "multi-width", for example "double-width" folding mechanisms can be arranged next to each other below the lowermost superstructure carriage B shown in FIG. 1. It is also possible to arrange several "single-width" folding mechanisms—for example two—behind each other several times—for example twice—. Four "single-width" folding mechanisms therefore result from this.

A mixture of "single-width" and "multiple-width", for example "double-width", folding mechanisms would also be possible.

It would also be possible to feed partial paper webs, longitudinally cut from several paper webs, to the paper web feeding device.

Driven traction rollers 74, 75 can also be provided for each partial paper web 67, 68.

An exchange of folding mechanisms would also be possible so that, corresponding to the required production, special folding mechanisms could be introduced and removed. All folding mechanisms can be equipped with frequency-controlled individual drives.

The levels C, D, on which the superstructure carriages A, B can be displaced, can be inclined upwardly or downwardly (V-shaped or roof-shaped) from a plane which intersects them, to the left or the right of the latter. This would be possible in case the superstructure carriages A, B would only be movable horizontally in, and opposite to the running direction of the paper web.

While a preferred embodiment of a paper web feeder in accordance with the present invention has been set forth fully and completely hereinabove, it will be apparent to one of skill in the art that a number of changes in, for example the type of printing press used, the overall width of the paper web and the like could be made without departing from the true spirit and scope of the present invention which is accordingly to be limited only by the following claims.

What is claimed is:

1. A paper web feeding device which is useable to feed a plurality of partial paper webs that have been cut longitudinally from paper webs to a number of folding mechanisms in a web-fed rotary printing press, said paper web feeding device comprising:

a first superstructure carriage supported for movement on a first plane in a first direction transverse to a production direction of the paper webs in the web-fed rotary printing press;

a plurality of first turning bars on said first superstructure carriage, said plurality of first turning bars diverting a first group of said plurality of partial paper webs transversely to said production direction and combining said first group of said plurality of partial paper webs into a first partial paper web strand;

a second superstructure carriage supported for movement on a second plane, different from said first plane, in said first direction transverse to said production direction of the paper webs in the web-fed rotary printing press; and a plurality of second turning bars on said second superstructure carriage, said plurality of second turning bars diverting a second group of said partial paper webs transversely to said production direction and combining said second group of said plurality of partial paper webs into a second partial paper web strand.

2. The paper web feeding device of claim 1 wherein at least one of said first and second superstructure carriages is displaceable transversely to the production direction of the paper webs.

3. The paper web feeding device of claim 1 wherein at least one of said first and second superstructure carriages is displaceable in the production direction of the paper webs.

4. The paper web feeding device of claim 1 wherein at least one of said first and second superstructure carriages is displaceable transversely to, and in the production direction of the paper webs.

5. The paper web feeding device of clam 1 further including a plurality of first adjustable longitudinal register devices on said first superstructure carriage and a plurality of second adjustable longitudinal register devices on said second superstructure carriage said plurality of first and second longitudinal register devices being equal in number to said plurality of first and second turning bars.

6. The paper web feeding device of claim 1 wherein said first and second superstructure carriages are positionable one on top of another.

7. The paper web feeding device of claim 1 further including a selectable folding mechanism assigned to each of said first and second superstructure carriages.

8. The paper web feeding device of claim 7 wherein each said selectable folding mechanism is a "single-width" folding mechanism.

9. The paper web feeding device of claim 7 wherein each said selectable folding mechanism is a "double-width" folding mechanism.

10. The paper web feeding device of claim 1 further including a traction device associated with each said turning bar.

* * * * *